US008397640B2

(12) United States Patent
Carson et al.

(10) Patent No.: US 8,397,640 B2
(45) Date of Patent: Mar. 19, 2013

(54) DYNAMIC SWITCHING SYSTEM FOR USE IN IN-LINE EXPLOSIVE TRAINS

(75) Inventors: Paul J. Carson, Mountain Top, PA (US); Eric E. Roach, Orlando, FL (US)

(73) Assignee: Lockheed Martin Corp., Bethesda, MD (US)

( * ) Notice: Subject to any disclaimer, the term of this patent is extended or adjusted under 35 U.S.C. 154(b) by 0 days.

(21) Appl. No.: 13/039,988

(22) Filed: Mar. 3, 2011

(65) Prior Publication Data

US 2012/0247356 A1 Oct. 4, 2012

Related U.S. Application Data

(60) Provisional application No. 61/309,904, filed on Mar. 3, 2010.

(51) Int. Cl.
*F42C 15/40* (2006.01)

(52) U.S. Cl. ..... 102/262; 102/275.8; 102/275.11; 89/6

(58) Field of Classification Search ..... 102/262–264
See application file for complete search history.

(56) References Cited

U.S. PATENT DOCUMENTS

| | | | | | |
|---|---|---|---|---|---|
| 4,662,281 | A * | 5/1987 | Wilhelm et al. | ..... | 102/494 |
| 4,677,913 | A * | 7/1987 | Farace | ..... | 102/215 |
| 5,138,946 | A * | 8/1992 | Soltz et al. | ..... | 102/201 |
| 5,245,926 | A * | 9/1993 | Hunter | ..... | 102/215 |
| 6,035,783 | A * | 3/2000 | Cho | ..... | 102/235 |
| 6,295,932 | B1 * | 10/2001 | Kane, III | ..... | 102/221 |
| 7,600,475 | B1 * | 10/2009 | Friedberg et al. | ..... | 102/265 |

* cited by examiner

*Primary Examiner* — Samir Abdosh
(74) *Attorney, Agent, or Firm* — Lee, Jorgensen, Pyle & Kewalramani, P.C.

(57) ABSTRACT

The presently disclosed technique pertains to in-line explosive trains, and, more particularly, to a dynamic switch for use in an in-line explosive train. In a first aspect, the presently disclosed technique includes a method for use in arming an in-line explosive train comprising: arming two S&A circuits independently of one another; transitioning each arming circuit to a dynamic control start state to initiate a pair of state machines, each state machine associate with a respective one of the S&A circuits; transitioning through the states of the state machine to turn a switch on and off. In a second aspect, the presently disclosed technique includes a dynamic safety switch for use in an in-line explosive train comprising: a pair of S&A circuits; a pair of state machines entering a predetermined cycle upon indication to arm from both the S&A circuits and cooperatively transitioning through the cycle; and a switch controlled by the cooperative transition of the state machines.

19 Claims, 3 Drawing Sheets

DYNAMIC SWITCHING SYSTEM FOR USE IN IN-LINE EXPLOSIVE TRAINS

CROSS-REFERENCE TO RELATED APPLICATIONS

The priority of U.S. Provisional Application Ser. No. 61/309,904, filed Mar. 3, 2010, and entitled "Dynamic Switching System for Use in In-Line Explosive Trains" in the name of the inventors Paul. J. Carson and Erich E. Roach is hereby claimed pursuant to 35 U.S.C. §119(e). This provisional application is also hereby incorporated by reference as if set forth verbatim herein.

STATEMENT REGARDING FEDERALLY SPONSORED RESEARCH OR DEVELOPMENT

Not applicable.

BACKGROUND

1. Field of the Technique

The presently disclosed technique pertains to in-line explosive trains, and, more particularly, to a dynamic switch for use in an in-line explosive train.

2. Description of the Related Art

This section of this document introduces various aspects of the art that may be related to various aspects of the present invention described and/or claimed below. It provides background information to facilitate a better understanding of the various aspects of the present invention. As the section's title implies, this is a discussion of "related" art. That such art is related in no way implies that it is also "prior" art. The related art may or may not be prior art. The discussion in this section of this document is to be read in this light, and not as admissions of prior art.

The majority of bomb fuzes use an "out-of-line" explosive train to achieve an acceptable level of safety. An out-of-line system is armed by moving the detonator into line with the rest of the explosive train. When unarmed there is a safety barrier between the detonator and the explosive train. An "in-line" system has the detonator always aligned with the explosive train. In-line refers to an uninterrupted explosive train. In-line explosive train systems were first developed for use in nuclear weapons to provide a highly reliable, safe, and precisely timed means of explosive initiation. The technology has matured, and with the introduction of low cost Exploding Foil Initiators ("EFI"), the technology has proliferated beyond nuclear weapon applications.

The inherent safety of the EFI in-line system is derived from the elimination of any pyrotechnics or primary explosives. Energetic materials used are only highly insensitive secondary explosives. Initiation of these energetic materials within the EFI utilizes a specific amplitude and frequency electric pulse. For an in-line fuze, the safe condition is defined when the voltage on the firing capacitor is less than 500 VDC and all safety features are in their safe state. By design, the EFI must be safe for any voltage level of 500 Volts or less directly applied to its detonation contacts.

All Fuze Safety Board's require that special safety precautions be taken when using any in-line detonation system. At a minimum it is required that three safety features be used that will stop the arming of the system and that one of these be dynamic. Dynamic requires that the switch be turned on and off in an oscillatory manor for arming to commence. Designing a switch that will do this is trivial but the Safety community wants the switch to do this without having any free running oscillator, clock, or frequency source dependence. This has proven to be a significant challenge that has yet to be fully solved.

The present invention is directed to resolving, or at least reducing, one or all of the problems mentioned above.

SUMMARY

In a first aspect, the presently disclosed technique includes a method for use in arming an in-line explosive train. The method comprises: arming two S&A circuits independently of one another; transitioning each arming circuit to a dynamic control start state to initiate a pair of state machines, each state machine associate with a respective one of the S&A circuits; transitioning through the states of the state machine to turn a switch on and off.

In a second aspect, the presently disclosed technique includes a dynamic safety switch for use in an in-line explosive train. The dynamic safety switch comprises: a pair of S&A circuits; a pair of state machines entering a predetermined cycle upon indication to arm from both the S&A circuits and cooperatively transitioning through the cycle; and a switch controlled by the cooperative transition of the state machines.

The above presents a simplified summary of the invention in order to provide a basic understanding of some aspects of the invention. This summary is not an exhaustive overview of the invention. It is not intended to identify key or critical elements of the invention or to delineate the scope of the invention. Its sole purpose is to present some concepts in a simplified form as a prelude to the more detailed description that is discussed later.

BRIEF DESCRIPTION OF THE DRAWINGS

The invention may be understood by reference to the following description taken in conjunction with the accompanying drawings, in which like reference numerals identify like elements, and in which.

While the invention is susceptible to various modifications and alternative forms, the drawings illustrate specific embodiments herein described in detail by way of example. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort, even if complex and time-consuming, would be a routine undertaking for those of ordinary skill in the art having the benefit of this disclosure.

One or more specific embodiments of the present invention will be described below. The present invention is not limited to the embodiments and illustrations contained herein, but include modified forms of those embodiments including portions of the embodiments and combinations of elements of different embodiments as come within the scope of the appended claims. In the development of any such actual implementation, as in any engineering or design project, numerous implementation-specific decisions must be made to achieve the developers' specific goals, such as compliance with system-related and business related constraints, which may vary from one implementation to another. Moreover, such a development effort might be complex and time consuming, but would nevertheless be a routine undertaking of design, fabrication, and manufacture for those of ordinary skill having the benefit of this disclosure.

Figure 1:
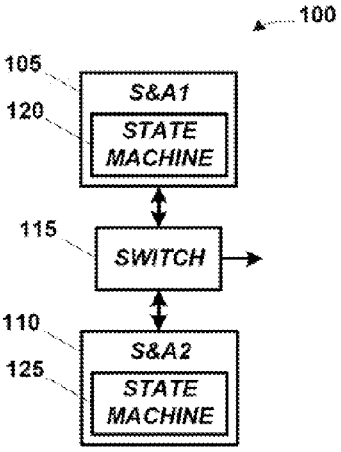
FIG. 1 depicts in a block diagram one particular embodiment of a dynamic switch for use in an in-line explosive train in accordance with one aspect of the presently disclosed technique.

FIG. 1 depicts in a block diagram one particular embodiment of a dynamic switch 100 for use in an in-line explosive train (not shown) in accordance with one aspect of the presently disclosed technique. The dynamic switch 100 may be, in some embodiments, one of three safety features and, in particular, a dynamic feature, employed in an in-line explosive train in accordance with requirements of the Fuze Safety Board. The dynamic switch 100 omits any free running oscillator.

Figure 3:
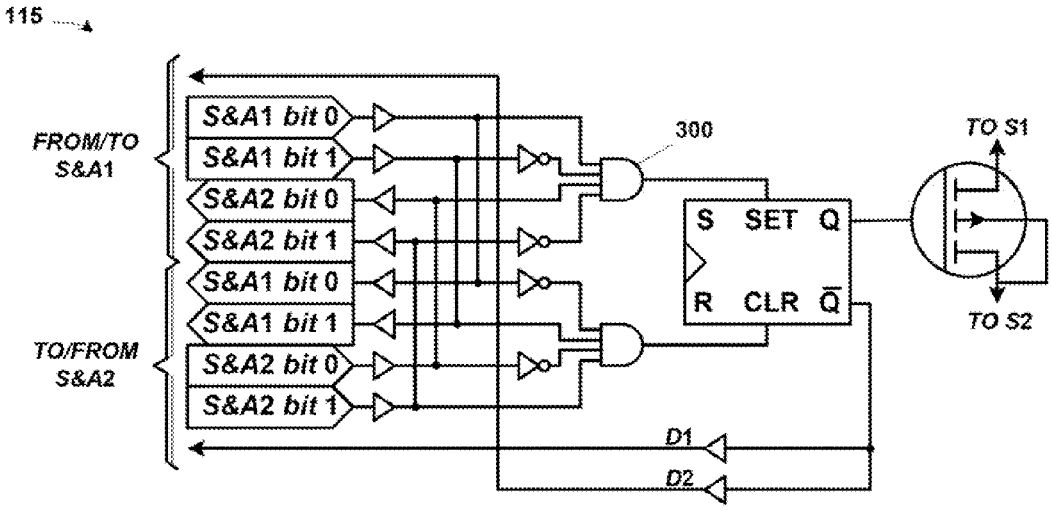
FIG. 3 diagrams one exemplary switch such as may be used to implement the switch first shown in FIG. 1.
Figure 2:
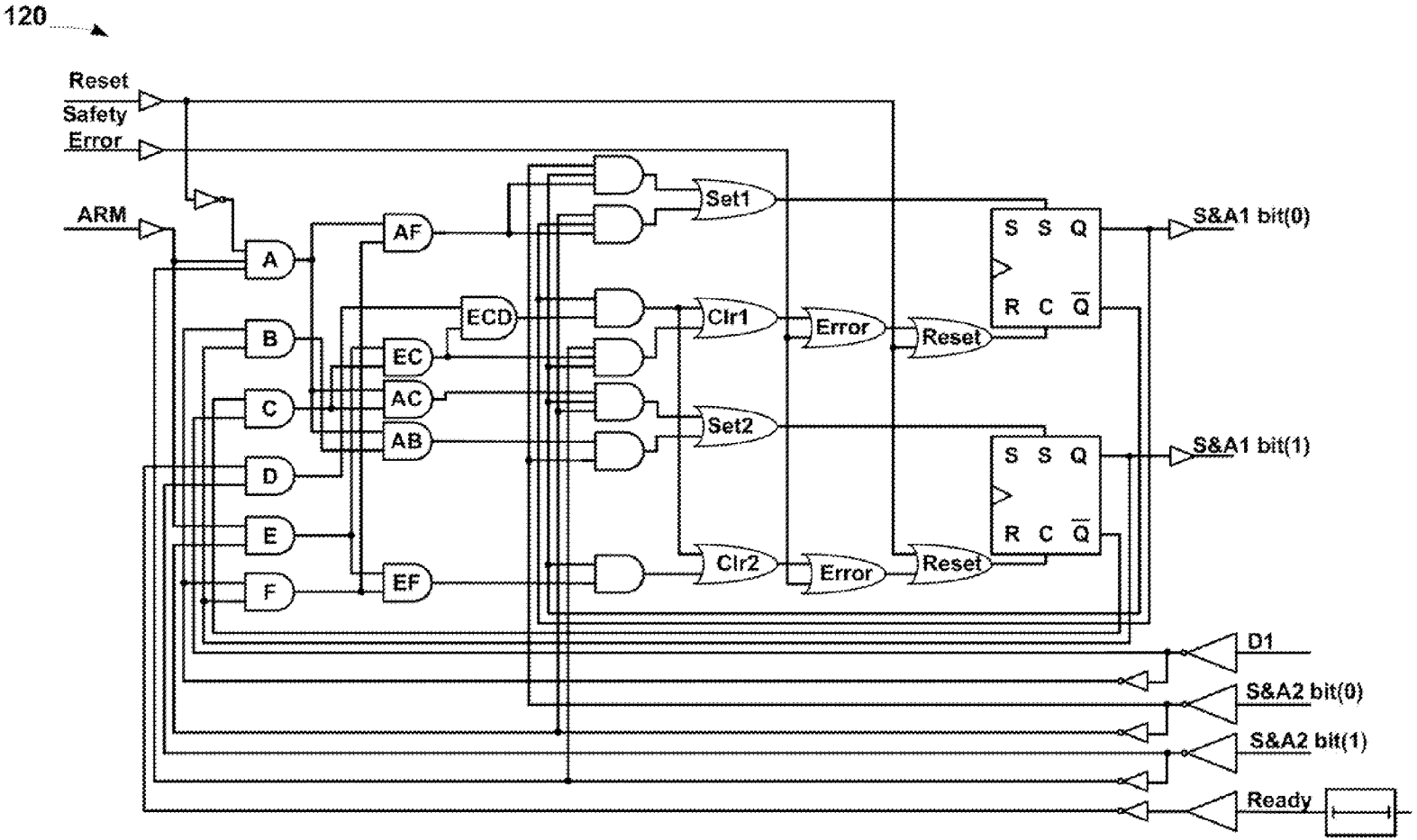
FIG. 2 diagrams one exemplary state machine such as may be used to implement the state machines first shown in FIG. 1.

The dynamic switch 100 comprises two safe and arm ("S&A") circuits 105, 110 and a switch 115. S&A circuits are quite well known in the art, and any suitable safe and arm circuit may be used. The S&A circuits 105, 110 have been modified by the inclusion of a respective state machine 120, 125. One exemplary implementation for the state machine 120 is shown in FIG. 2. Note that the state machines 120, 125 may each be implemented using the same design, varying only in the inputs and outputs. One exemplary embodiment for the switch 115 is shown in FIG. 3. Note that the invention is not limited to these particular implementations.

The system uses two independent arming systems, i.e., the S&A circuits 105, 110. After both S&A circuits 105, 110 have independently decided to arm, each S&A circuit 105, 110 will independently enter a dynamic control start state and await the other to provide input that will allow dynamic arming progression to take place.

Figure 4:
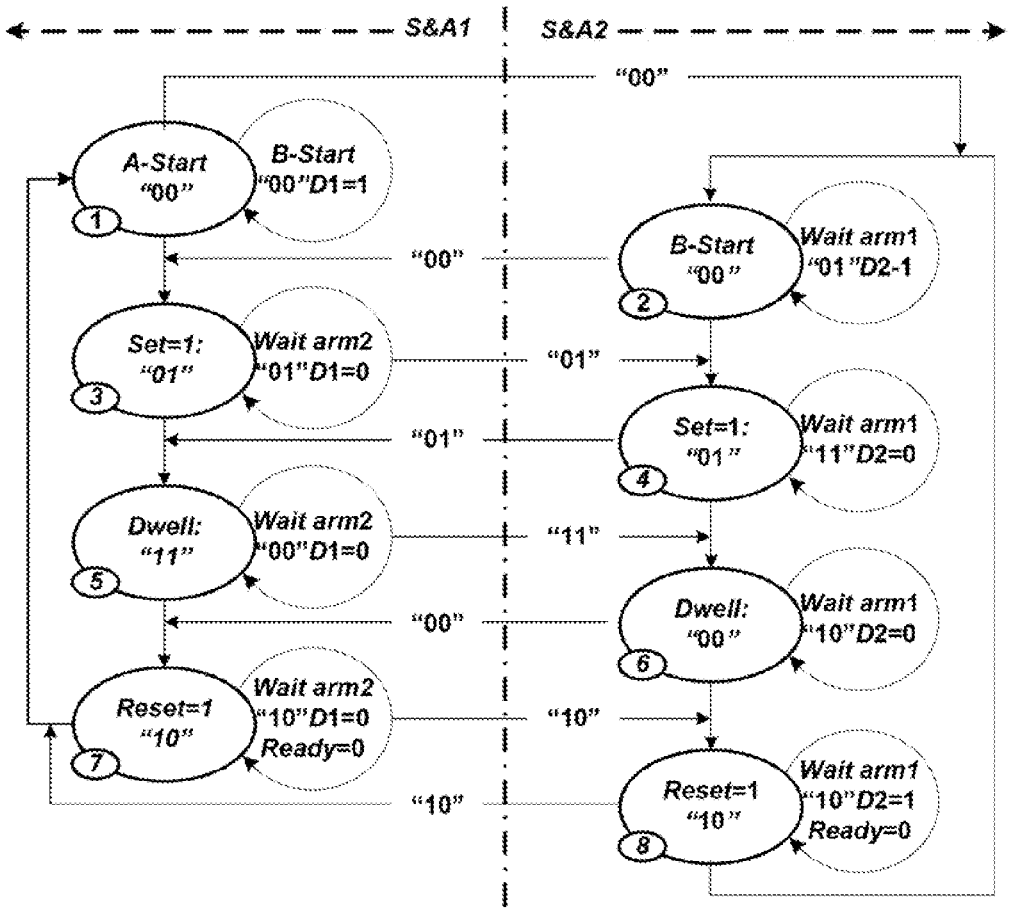
FIG. 4 illustrates an eight-step progression is required to produce one dynamic arming cycle in accordance with one particular embodiment of the present invention.

FIG. 4 shows the progression followed by the two S&A circuits 105, 110. Referring now to FIG. 4, S&A1 state decisions are shown on the left and S&A2 state decisions on the right. Each S&A enters the "Start" state when all conditions are met to start the dynamic arming process. Progression through the eight steps occurs when the two state machines 120, 125 send correct information to each other. The loopback arrows, shown in FIG. 4, show what each of the arming systems is waiting for before moving to its next state. Each S&A state machine 120, 125 receives dynamic (altering) inputs from the other S&A state machine. Each S&A state machine 120, 125 receives feedback from the dynamic switching system; the feedback is shown as D1 and D2 in FIG. 3.

It takes time for each S&A state machine 120, 125 to send, receive, process and respond to the other as the two arming systems cycle through the eight steps. It requires one cycle through the eight steps to produce one cycle of dynamic switch output. The time required to cycle through the eight steps creates a natural frequency without resorting to the use of any free running clock. The period of the dynamic arming switch 100 will be the time required to complete one eight step loop. This period can be altered by placing intentional delays in the logical progression path. In the diagram D1 and D2 are fixed delay paths that will act to slow the system down. By using transformed feedback to moderate the delay, an optimized output solution required for efficient transformer action can be achieved. Only the logical and dynamic sharing of control, back and forth between the S&A state machines 120, 125, can create the dynamic switch output required to arm the system.

In FIG. 3, the top AND gate 300 requires the combined S&A1 and S&A2 signals to be "0101" to set the dynamic switch 100 "on", (this occurs at step 4 in the eight step process) and "1010" to turn the switch "off" (step 8 of the process). Each of the four control signals must all dynamically change from "1" to "0" in a logical and predetermined way for the arming process to continue. Any error with any of the signals; shorts, opens, or failure to respond, will halt the dynamic switching action and result in a failsafe condition.

To summarize, the required dynamic oscillation is caused by the logical "dynamic" cycle of two fully enabled safe and arm systems working in agreement. By using grey code communicated logic, where only one bit is changed at any step progression, the possibility of a race condition is removed and the need for a clock is safely eliminated. The system will derive the dynamic arming output using only intelligent communication between the two independent S&A systems. This system is not dependent on any oscillator or clock, free running or otherwise.

Table 1 shows the progression of logic that occurs to complete one cycle of the dynamic arming process. No step can advance unless the previous step has achieved the logic outputs as shown. The progression will halt in the off state when a sensor indicates that the system is fully armed (Ready=1) The seeming complexity is required to make the system failsafe and capable of generating a dynamic output frequency with no free running clock system whatsoever. This system can be constructed entirely out of discrete hardware. See FIG. 4 for a brief explanation of the eight step process.

TABLE 1

One cycle of the dynamic arming sequence.

| | S&A1 | | | S&A2 | | | Flip-Flop | |
|---|---|---|---|---|---|---|---|---|
| Step # | Bit(1) | Bit(0) | D1 | Bit(1) | Bit(0) | D2 | MOSFET | Notes: |
| 1) Start S&A1 | 0 | 0 | 1 | 0 = first entry, | 0 | 1 | OFF | This state is first entered when S&A1 ready to arm. S&A1 sends |

TABLE 1-continued

One cycle of the dynamic arming sequence.

| | S&A1 | | | S&A2 | | | Flip-Flop | |
|---|---|---|---|---|---|---|---|---|
| Step # | Bit(1) | Bit(0) | D1 | Bit(1) | Bit(0) | D2 | MOSFET | Notes: |
| | | | | 1 = loop* | | | | "00" then S&A1 waits for S&A2 = "00" and D1 = '1' (Dynamic switch off) |
| 2) Start S&A2 | 0 | 0 | 1 | 0 | 0 | 1 | OFF | This state is entered when S&A2 first ready to arm. S&A2 waits for S&A1 = '01" and D2 = '1' (Dynamic switch off) |
| 3) S&A1 moves to step 3 | 0 | 1 | 1 | 0 | 0 | 1 | OFF | If S&A1 is ready to arm first it waits here for S&A2 to respond with "01" and D2 = '1' (Dynamic switch off) |
| 4) S&A2 moves to step 4 | 0 | 1 | 1 | 0 | 1 | 1 | OFF | S&A2 reads "01" from S&A1 and D2 = '1' then responds with "01" |
| Wait delay | 0 | 1 | 0 | 0 | 1 | 0 | ON | With both S&A1 and S&A2 sending "01" the dynamic switch turns on and after fixed delay D1&D2 will turn off |
| 5) S&A1 moves to step 5 | 1 | 1 | 0 | 0 | 1 | 0 | ON | S&A1 reads "01" from S&A2 and D1 on = '0', then S&A1 sends "11" |
| 6) S&A2 moves to step 6 | 1 | 1 | 0 | 0 | 0 | 0 | ON | S&A2 reads S&A1 = "11" and D2 = '0' then responds with "00" |
| 7) S&A1 moves to step 7 | 1 | 0 | 0 | 0 | 0 | 0 | ON | S&A1 reads "00" and D1 = '0' then replies with ""10" |
| 8) S&A2 moves to step 8 | 1 | 0 | 0 | 1 | 0 | 0 | ON | S&A2 reads '10" from S&A1 and D2 = '0' then responds with "10" |
| Wait delay | 1 | 0 | 1 | 1 | 0 | 1 | OFF | With both S&A1 and S&A2 sending "10" the dynamic switch turns off and D1&D2 turn on after a fixed delay, D1 = D2 = '1' |
| Loop back to step 1* this pattern of signals replaces step 1 after first time through the loop | 0 | 0 | 1 | 1 | 0 | 1 | OFF | S&A1 reads S&A2 = "10" and D1 = 1. then moves to the start state where the process is continued until "Ready = 1" is received from the fireset |

Note that the process depicted in FIG. 4 and discussed above employed by the S&A arming switches has eight steps. This is not necessary to the practice of the invention as the number of steps may vary depending upon implementation specific design constraints. Other numbers of steps, such as six or ten, may be employed in alternative embodiments.

Figure 5:
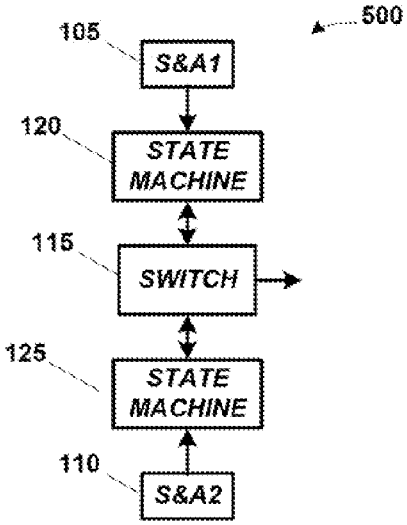
FIG. 5 depicts in a block diagram a second particular embodiment of a dynamic switch for use in an in-line explosive train in accordance with one aspect of the presently disclosed technique.

FIG. 5 depicts in a block diagram a second particular embodiment 500 of a dynamic switch for use in an in-line explosive train in accordance with one aspect of the presently disclosed technique. In this embodiment, the state machines 120, 125 do not comprise a portion of the S&A circuits 105, 110. Since the S&A circuits 105, 110 may be conventionally implemented, this means that existing systems may be "retrofitted" by replacing conventional switching mechanism with the state machines 120, 125 and switch 115.

The phrase "capable of" as used herein is a recognition of the fact that some functions described for the various parts of the disclosed apparatus are performed only when the apparatus is powered and/or in operation. Those in the art having the benefit of this disclosure will appreciate that the embodiments illustrated herein include a number of electronic or electro-mechanical parts that, to operate, require electrical power. Even when provided with power, some functions described herein only occur when in operation. Thus, at times, some embodiments of the apparatus of the invention are "capable of" performing the recited functions even when they are not actually performing them—i.e., when there is no power or when they are powered but not in operation.

This concludes the detailed description. The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed:

1. A method for use in arming an in-line explosive train, comprising:

arming two safe and arm circuits independently of one another;

transitioning each safe and arm circuit to a dynamic control start state independently of the other safe and arm circuit to initiate a pair of state machines, each state machine being associated with a respective one of the S&A circuits;

indicating the transition to the dynamic control start state for each state machine to the other state machine; and cooperatively transitioning through the states of the state machines to turn a switch on and off.

2. The method of claim 1, wherein the arming, the dynamic control start state transitioning, indicating, and state transitioning are performed by a dynamic safety switch comprising:

the two safe and arm circuits;

the respective state machines, each of which enters a predetermined cycle upon indication to arm from both the safe and arm circuits and cooperatively transitions through the cycle; and the switch, controlled by the cooperative transition of the state machines.

3. A dynamic safety switch for use in an in-line explosive train, comprising:

a pair of safe and arm circuits;

a pair of state machines entering a predetermined cycle upon independent indication to arm from both the safe and arm circuits and cooperatively transitioning through the cycle; and a switch controlled by the cooperative transition of the state machines.

4. The method of claim 1, wherein cooperatively transitioning through the states of the state machines includes transitioning to a subsequent state in a first one of the state machines only after receiving an indication of state transition from the second state machine.

5. The method of claim 4, wherein the indication of state transition from the second state machine comprises an indication of transition to a dynamic control start state.

6. The method of claim 1, wherein the indication of state transition from the second state machine includes communicating in a Grey code logic.

7. The method of claim 1, wherein each state machine comprises a portion of its respective, associated safe and arm circuit.

8. The method of claim 1, cooperatively transitioning through the states of the state machines includes experiencing at least one intentional delay between states.

9. The dynamic safety switch of claim 3, wherein cooperatively transitioning through the cycle includes transitioning to a subsequent state in a first one of the state machines only after receiving an indication of state transition from the second state machine.

10. The dynamic safety switch of claim 9, wherein the indication of state transition from the second state machine comprises an indication of transition to a dynamic control start state.

11. The dynamic safety switch of claim 9, wherein the indication of state transition from the second state machine includes communicating in a Grey code logic.

12. The dynamic safety switch of claim 3, wherein each state machine comprises a portion of a respective, associated safe and arm circuit.

13. The dynamic safety switch of claim 3, cooperatively transitioning through the cycle includes experiencing at least one intentional delay between states.

14. An inline explosives train, comprising:

dynamic safety switch for use in an in-line explosive train, including:

a pair of safe and arm circuits;

a pair of state machines entering a predetermined cycle upon independent indication to arm from both the safe and arm circuits and cooperatively transitioning through the cycle; and a switch controlled by the cooperative transition of the state machines; and a detonator controlled by the dynamic safety switch.

15. The inline explosives train of claim 14, wherein cooperatively transitioning through the cycle includes transitioning to a subsequent state in a first one of the state machines only after receiving an indication of state transition from the second state machine.

16. The inline explosives train of claim 15, wherein the indication of state transition from the second state machine comprises an indication of transition to a dynamic control start state.

17. The inline explosives train of claim 15, wherein the indication of state transition from the second state machine includes communicating in a Grey code logic.

18. The inline explosives train of claim 14, wherein each state machine comprises a portion of a respective, associated safe and arm circuit.

19. The inline explosives train of claim 14, cooperatively transitioning through the cycle includes experiencing at least one intentional delay between states.

* * * * *